US011873456B2

(12) United States Patent
Jeon et al.

(10) Patent No.: US 11,873,456 B2
(45) Date of Patent: Jan. 16, 2024

(54) PROCESS OF PRODUCING HIGH-QUALITY LUBE BASE OIL BY USING REFINED OIL FRACTION OF WASTE LUBRICANT

(71) Applicants: SK INVOVATION CO., LTD., Seoul (KR); SK ENMOVE CO., LTD., Seoul (KR)

(72) Inventors: Young Wook Jeon, Daejeon (KR); Jin Hee Ok, Daejeon (KR); Kyung Seok Noh, Daejeon (KR); Do Woan Kim, Daejeon (KR)

(73) Assignee: SK INNOVATION CO., LTD. and SK ENMOVE CO., LTD.

( * ) Notice: Subject to any disclaimer, the term of this patent is extended or adjusted under 35 U.S.C. 154(b) by 0 days.

(21) Appl. No.: 17/890,252

(22) Filed: Aug. 17, 2022

(65) Prior Publication Data

US 2023/0054666 A1 Feb. 23, 2023

(30) Foreign Application Priority Data

Aug. 17, 2021 (KR) ..... 10-2021-0108145

(51) Int. Cl.
*C10G 69/02* (2006.01)
*C10G 61/04* (2006.01)
(Continued)

(52) U.S. Cl.
CPC ..... *C10G 69/02* (2013.01); *C10G 61/04* (2013.01); *C10M 101/02* (2013.01); *C10M 175/005* (2013.01); *C10M 175/0016* (2013.01); *C10M 175/0033* (2013.01); *C10G 2300/1007* (2013.01); *C10G 2400/10* (2013.01);
(Continued)

(58) Field of Classification Search
CPC ..... C10G 69/02; C10G 61/04; C10G 2300/1007; C10G 2400/10; C10M 101/02; C10M 175/0016; C10M 175/0033; C10M 175/005; C10M 2203/1006;
(Continued)

(56) References Cited

U.S. PATENT DOCUMENTS 6,117,309 A 9/2000 Daspit et al.
10,385,286 B2 8/2019 Pintar et al.
(Continued)

FOREIGN PATENT DOCUMENTS

EP 2563886 A1 3/2013
JP 3131916 B2 2/2001
(Continued)

OTHER PUBLICATIONS

EP22189115.3 Search Report dated Dec. 7, 2022, 8 pgs.

*Primary Examiner* — James C Goloboy
*Assistant Examiner* — Francis C Campanell
(74) *Attorney, Agent, or Firm* — Bracewell LLP; Brad Y. Chin

(57) ABSTRACT

Proposed is a process of producing a high-quality lube base oil using a refined oil fraction obtained from waste lubricant as a feedstock. The process includes purifying waste lubricant to obtain a refined oil fraction, pretreating the refined oil fraction, and blending the pretreated refined oil fraction with unconverted oil (UCO), before or after vacuum distillation and catalytic dewaxing of the unconverted oil, or between the vacuum distillation and the catalytic dewaxing of the unconverted oil.

15 Claims, 3 Drawing Sheets

(51) Int. Cl.

| | |
|---|---|
| ***C10M 101/02*** | (2006.01) |
| ***C10M 175/00*** | (2006.01) |
| *C10N 30/00* | (2006.01) |
| *C10N 30/02* | (2006.01) |
| *C10N 30/20* | (2006.01) |
| *C10N 70/00* | (2006.01) |

(52) U.S. Cl.
CPC . *C10M 2203/1006* (2013.01); *C10N 2030/02* (2013.01); *C10N 2030/20* (2013.01); *C10N 2030/41* (2020.05); *C10N 2030/43* (2020.05); *C10N 2070/00* (2013.01)

(58) Field of Classification Search
CPC ..... C10N 2030/02; C10N 2030/20; C10N 2030/41; C10N 2030/43; C10N 2070/00
USPC ..... 208/87
See application file for complete search history.

(56) References Cited

U.S. PATENT DOCUMENTS

2015/0247103 A1* 9/2015 Sloan ..... C10M 161/00 508/591
2017/0283734 A1* 10/2017 MacDonald ..... B01D 3/40
2019/0016973 A1 1/2019 Murray
2020/0291321 A1 9/2020 Kim et al.

FOREIGN PATENT DOCUMENTS

| | | | |
|---|---|---|---|
| JP | 3781444 | B2 | 5/2006 |
| JP | 2007051174 | A | 3/2007 |
| JP | 2013534559 | A | 9/2013 |
| JP | 2015034205 | A | 2/2015 |
| JP | 5757051 | B2 | 7/2015 |
| KR | 900003888 | B1 | 6/1990 |
| KR | 930004165 | B1 | 5/1993 |
| KR | 960013606 | B1 | 10/1996 |
| KR | 20000003150 | A | 1/2000 |
| KR | 20070116074 | A | 12/2007 |
| KR | 20110121334 | A | 11/2011 |
| KR | 101679426 | B1 | 11/2016 |
| KR | 102049750 | B1 | 11/2019 |
| KR | 102053871 | B1 | 12/2019 |
| WO | 2006096396 | A2 | 9/2006 |

* cited by examiner

PROCESS OF PRODUCING HIGH-QUALITY LUBE BASE OIL BY USING REFINED OIL FRACTION OF WASTE LUBRICANT

CROSS REFERENCE TO RELATED APPLICATION

The present application claims priority to Korean Patent Application No. 10-2021-0108145, filed Aug. 17, 2021, the entire contents of which is incorporated herein for all purposes by this reference.

BACKGROUND OF THE DISCLOSURE

Field of the Disclosure

The present disclosure relates to a process of producing a high-quality lube base oil by treating waste lubricant through a series of processing steps. More particularly, the present disclosure relates to a process of producing group III- or higher-grade lube base oil by pretreating a refined oil fraction obtained by refining waste lubricant, blending the refined oil fraction with unconverted oil (UCO) of a fuel oil hydrogenation reaction, and subjecting the mixture to vacuum distillation and catalytic dewaxing.

Description of the Related Art

In the past, waste lubricant underwent a series of refining processes to obtain refined oil. The entire amount of the refined oil was used as fuel oil in Korea. However, in other countries, a portion of the refined oil was used as fuel oil, and the remainder was used as low-grade regenerated base oil.

Typically, waste lubricant contains additives, which contain a large amount of impurity such as sulfur (at a concentration of about 1000 to 5000 ppm), nitrogen (at a concentration of about 500 to 5000 ppm) and chlorine (at a concentration of about 100 to 5000 ppm). When waste lubricant is refined and used as fuel oil, there are problems in that the fuel oil causes environmental pollution during combustion thereof, and the fuel oil is economically disadvantageous due to a low density and calorific value thereof.

On the other hand, good lube base oils have a high viscosity index, high stability (resistant to oxidation, heat, UV, etc.), and low volatility. The American Petroleum Institute (API) classifies lube base oils according to their quality as shown in Table 1 below.

TABLE 1

| Group | Content of sulfur (ppm) | | Saturation (%) | Viscosity index (VI) |
|---|---|---|---|---|
| I | >300 | and/or | <90 | 80-120 |
| II | ≤300 | and | ≥90 | 80-120 |
| III | ≤300 | and | ≥90 | >120 |
| VI | | All polyalphaolefins(PAOs) | | |
| V | | All stocks not in Groups I-IV | | |

In the above classification, the quality as a lube base oil is evaluated to be superior as it goes from Group I to V. Among them, Group III lube base oil is typically produced through a high-level hydrocracking reaction. In general, Group III or higher-grade lube base oil is produced from unconverted oil, which is the heavy fraction remaining without being converted to fuel oil in the fuel oil hydrocracking process. Korean Patent Publication No. 1996-0013606 and the like disclose a high-grade lube base oil production method from unconverted oil. In the case of using waste lubricant as a feedstock for a process of producing a Group III- or higher-grade lube base oil, as described above, there are significant advantages in terms of environmental and economical aspects compared to the case of using waste lubricant as fuel oil. Therefor, research on this technology has been actively conducted. However, due to limitations in characteristics such as a high impurity content and a chemical composition of waste lubricant, it is difficult to produce a Group III or higher grade lube base oil using only the waste lubricant as a raw material (Patent Document) Korean Patent Publication No. 1996-0013606

SUMMARY OF THE DISCLOSURE

Accordingly, the present disclosure is intended to provide a method of obtaining a high-grade lube base oil through a series of steps including: refining waste lubricant to prepare a refined oil fraction to be used as a feedstock in a Group III- or higher-grade lube base oil preparation process; pretreating the refined oil; blending the pretreated refined oil with unconverted oil so that the mixture has suitable properties and a suitable composition as the feedstock for the high-grade lube base oil preparation process; and subjecting the mixture to vacuum distillation and catalytic dewaxing, thereby obtaining a final product.

In one aspect of the present disclosure, there is provided a process of producing a high-quality lube base oil using a refined oil fraction obtained from waste lubricant as a feedstock, the process comprising the steps of: purifying the waste lubricant to produce a refined oil fraction; pretreating the refined oil fraction; and blending the pretreated refined oil fraction with unconverted oil (UCO) before or after subjecting the unconverted oil to vacuum distillation and catalytic dewaxing, or between the vacuum distillation and the catalytic dewaxing of the unconverted oil.

In one embodiment of the present disclosure, the step of preparing the refined oil fraction may include centrifuging the waste lubricant, distilling at atmospheric pressure, distilling under a reduced pressure, and combinations thereof.

In one embodiment of the present disclosure, the pretreatment of the refined oil fraction may include solvent extracting or hydrotreating the refined oil fraction.

In one embodiment of the present disclosure, a solvent used for solvent extraction may be selected from the group consisting of N-methyl-2-pyrrolidone, sulfolane, DMSO, Furfural, phenol, acetone, and combinations thereof.

In one embodiment of the present disclosure, the solvent extraction may be performed at a temperature in a range of 40° C. to 120° C. and a pressure in a range of from an atmospheric pressure to 10 kg/cm$^2$.

In one embodiment of the present disclosure, the solvent extraction may be performed under a solvent to oil volume ratio of 1:1 to 6:1.

In one embodiment of the present disclosure, the hydrogenation reaction may be performed at a temperature in a range of from 200° C. to 400° C. and a pressure in a range of from the atmospheric pressure to 200 kg/cm$^2$.

In one embodiment of the present disclosure, the vacuum distillation may be performed before the catalytic dewaxing.

In one embodiment of the present disclosure, the catalytic dewaxing may be performed in the presence of a catalyst including an EU-2 zeolite carrier.

In one embodiment of the present disclosure, the blending amount of the refined oil fraction with respect to the unconverted oil may be 3% by volume or more and 50% by volume or less.

In one embodiment of the present disclosure, the mixture in which the refined oil fraction and the unconverted oil are blended may have a sulfur content of less than 50 ppm, a nitrogen content of less than 10 ppm, and a chlorine content of less than 2 ppm.

In one embodiment of the present disclosure, the lube base oil may have a viscosity index of 120 or more and a saturation degree of 90% or more.

In one embodiment of the present disclosure, the lube base oil may have a Saybolt color value of 27 or more.

In one embodiment of the disclosure, the lube base oil may have a saturation degree of 99% or more.

In one embodiment of the disclosure, the content of each of sulfur, nitrogen, and chlorine in the lube base oil may be lower than 1 ppm.

According to the present disclosure, it is possible to regenerate waste lubricant not as fuel oil but as a high-quality lube base oil, thereby enabling waste lubricant to be used more economically and environment-friendly. In addition, according to the present disclosure, a refined oil fraction obtained by refining waste lubricant is blended with unconverted oil, and then the mixture is introduced into catalytic dewaxing. Since the refined oil fraction (or the waste lubricant) contains little or substantially no wax component, the method of the present disclosure makes it possible to produce a lube base oil with a relatively high yield compared to the process of producing a lube base oil using only unconverted oil as a feedstock.

DESCRIPTION OF THE PREFERRED EMBODIMENTS

Figure 1:
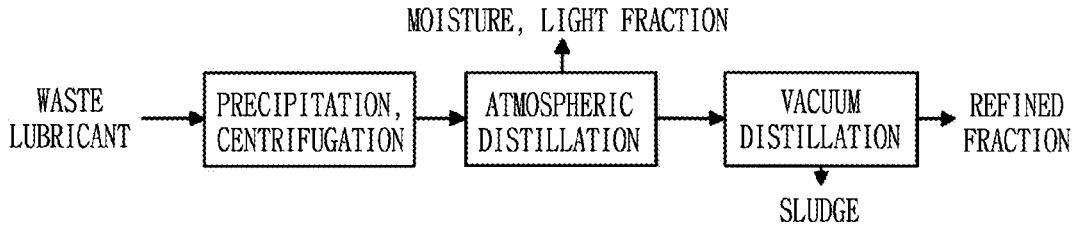
FIG. 1 is a flowchart showing a step of refining waste lubricant to prepare a refined oil fraction, according to the present disclosure.

As used herein, the term "unconverted oil (UCO)" refers to a heavy fraction remaining without being converted to fuel oil through a fuel oil hydrocracking process.

As used herein, the term "waste lubricant" refers to used lubricant. In general, lubricant contains a lube base oil and various additives. The additives include a large amount of impurity that is not suitable for use in a lube base oil. For this reason, waste lubricant also contains a large amount of impurity. For example, waste lubricant may contain 1000 to 5000 ppm of sulfur, 500 to 5000 ppm of nitrogen, 100 to 5000 ppm of chlorine, and other metallic impurities that may be introduced during lubrication. In addition, the waste lubricant has a specific gravity of 0.8 to 0.9, a kinematic viscosity (at 100° C.) of 2 to 20 cSt, a viscosity index of 60 to 150, a pour point of −18° C. to 12° C., and an aromatic content of 10 wt % or more, a black color of 8 to 10 according to ASTM standards, and a high sediment content, and may contain some moisture.

As used herein, the term "refined oil fraction" refers to an oil component resulting from a process in which waste lubricant undergoes centrifugal separation, atmospheric distillation, vacuum distillation, and combinations thereof. The refined oil fraction has a reduced impurity content compared to the original waste lubricant. For example, the refined oil fraction may have a sulfur content of less than 1000 ppm, a nitrogen content of less than 500 ppm, and a chlorine content of less than 2000 ppm.

In one aspect of the present disclosure, there is provided a process of producing a high-quality lube base oil using a refined oil fraction of waste lubricant, and the process may include refining the waste lubricant to prepare the refined oil fraction.

The step of preparing the refined oil fraction may include centrifuging the waste lubricant, distilling at atmospheric pressure, distilling under a reduced pressure, and combinations thereof.

The centrifugation is to separate and remove impurities present in the waste lubricant by precipitation and may be performed at a rotation speed of about 100 rpm to 3000 rpm. Instead of the centrifugal separation, natural sedimentation may be used to remove the impurities. However, the centrifugal separation is more preferable in terms of separation speed and performance.

After high-density solid impurities that are not miscible with the waste lubricant are primarily removed by the centrifugal separation, the waste lubricant undergoes atmospheric distillation performed under atmospheric pressure. The atmospheric distillation is performed at a temperature of about 50° C. to 350° C. As the atmospheric distillation temperature increases, fractions in the waste lubricant are distilled and fractionated in order of lower boiling points. Among the fractions fractionated through the atmospheric distillation step, a fraction having a boiling point of about 150° C. or higher is collected to produce the refined oil fraction.

The oil fraction collected in the atmospheric distillation step undergoes the vacuum distillation. The vacuum distillation is performed for further fractionation of the oil fraction obtained in the atmospheric distillation step. When the distillation temperature is increased for the fractionation of the oil fraction under atmospheric pressure, oil fraction cracking may occur. For this reason, this step is performed in reduced pressure and mild temperature conditions. The vacuum distillation may be performed at a pressure of 10 torr or less and a temperature of 150° C. to 350° C. During the vacuum distillation step, a fraction having a boiling point of 300 to 550° C. is collected, and the collected fraction is referred to as a refined oil fraction. The refined oil fraction has a specific gravity of about 0.8 to 1.0, a kinematic viscosity of about 4 to 6 cSt at a temperature of 100° C., a viscosity index (VI) of about 80 to 150, and a pour point of about −20° C. to 0° C. In addition, the refined oil fraction has a sulfur content of about 200 to 1000 ppm, a nitrogen content of about 200 to 500 ppm, and a chlorine content of about 30 to 2000 ppm. That is, the refined oil fraction has a reduced impurity content compared to the waste lubricant. The refined oil fraction shows a brown color of about 5 to 6 according to ASTM standards. By the centrifugation and two-step distillation, the refined oil fraction has a reduced content of sediment and moisture compared to the original waste lubricant.

The process of the present disclosure may include pretreating the refined oil fraction. The pretreatment refers to a step of additionally treating the refined oil fraction to minimize the influence of the refined oil on the process and the catalyst before the refined oil fraction is blended with unconverted oil and then introduced into the lube base oil production process. The pretreatment includes extracting an oil component through solvent extraction and hydrotreating the refined oil fraction.

The solvent extraction of the refined oil fraction is a step of blending the refined oil fraction and a solvent in a blending tank, a step of allowing the mixture to stand still to reach phase separation, thereby obtaining a phase in which oil is a main component, and a step of removing a phase containing a large amount of impurity. The solvent used for the solvent extraction is a solvent having a higher affinity to impurities than the oil component in the refined oil fraction. As the solvent, N-methyl-2-pyrrolidone (NMP), sulfolane, DMSO, Furfural, phenol and acetone are commonly used. The solvent has a high affinity to impurities and a low affinity to the oil component in the refined oil fraction, so that the solvent is phase-separated from the oil component in the refined oil fraction. Any solvent may be used without limitation as long as it exhibits a different volatility in the subsequent solvent separation step.

The solvent extraction of the refined oil fraction is carried out at a temperature of about 30° C. to 200° C., preferably about 30° C. to 150° C., and more preferably about 40° C. to 120° C., and at a pressure in a range of atmospheric pressure to 20 kg/cm$^2$, preferably in a range of atmospheric pressure to 15 kg/cm$^2$, more preferably in a range of atmospheric pressure to 10 kg/cm$^2$.

In addition, the volume ratio of the solvent used in the solvent extraction step of the refined oil fraction with respect to the oil component in the refined oil fraction is 1:1 to 6:1, preferably 1:1 to 5:1, 1:1 to 4:1, 1:1 to 3:1, 1:1 to 2:1, 2:1 to 5:1, 2:1 to 4:1, 2:1 to 3:1, 3:1 to 5:1, 3:1 to 4:1, or 4:1 to 5:1. The above volume ratio is preferable in terms of the balance between the level of impurity removal through the solvent extraction and the yield of the lube base oil subsequently produced from the pretreated refined oil fraction.

After the solvent extraction step, the refined oil fraction has a specific gravity of 0.8 to 0.9, a kinematic viscosity (at 100° C.) of 4 to 6 cSt, a viscosity index of 110 to 130, a pour point of −18° C. to −3° C., and a sulfur content of less than 150 ppm, a nitrogen content of less than 100 ppm, and a chlorine content of less than 20 ppm. That is, after the solvent extraction, the refined oil fraction may have improved characteristics and a reduced impurity content, may exhibit a light brown color of about 2 to 4 according to ASTM standards, and may have a reduced sediment content compared to the original refined oil which has not yet undergone the solvent extraction.

The hydrotreating of the refined oil fraction is a step of hydrogenating the refined oil fraction at high temperature and high pressure in the presence of a catalyst to remove sulfur, nitrogen, chlorine, and other metallic impurities contained in the refined oil fraction and is a step of saturating the unsaturated hydrocarbons present in the refined oil fraction.

The hydrotreating may be performed in the presence of a catalyst. As catalyst for hydrotreating, Ni—Mo-based catalysts, Co—Mo-based catalysts, Raney nickel, Raney cobalt, and platinum-based catalysts may be used, but the catalysts for hydrotreating are not limited thereto. Any hydrogenation catalyst having an effect of promoting a hydrogen saturating reaction and an impurity removal reaction may be used without limitation.

The hydrotreating is carried out under the following conditions: a temperature range of about 200° C. to 500° C., preferably about 250° C. to 450° C., and more preferably about 300° C. to 400° C.; a pressure range of 50 to 300 kg/cm$^2$, preferably 50 to 250 kg/cm$^2$, and more preferably 100 to 200 kg/cm$^2$; a liquid hourly space velocity (LHSV) range of 0.1 to 5.0 hr$^{-1}$, preferably 0.3 to 4.0 hr$^{-1}$, and more preferably 0.5 to 3.0 hr$^{-1}$; a hydrogen-to-refined oil fraction volume ratio range of 300 to 3000 Nm$^3$/m$^3$, preferably 500 to 2500 Nm$^3$/m$^3$, and more preferably 1000 to 2000 Nm$^3$/m$^3$. The above conditions are within a range in which the lifespan of a dewaxing catalyst is not affected, a removal level of impurity such as sulfur and nitrogen present in the refined oil fraction is minimized, and the yield loss of a final product, which is a lube base oil, is minimized.

After the hydrotreating step, the refined oil fraction has a specific gravity of 0.8 to 0.9, a kinematic viscosity (at 100° C.) of 4 to 6 cSt, a viscosity index of 110 to 130, a pour point of −18° C. to −3° C., and a sulfur content of less than 150 ppm (preferably, 20 ppm or less), a nitrogen content of less than 50 ppm (preferably, 20 ppm or less), and a chlorine content of 1 ppm or less. That is, the refined oil fraction may have improved characteristics and have a reduced impurity content after the hydrotreating. In addition, the refined oil may exhibit a yellow color of about 0.5 to 1 according to ASTM standards (corresponding to a Saybolt color scale of 16) after the hydrotreating.

The process may further include a step of blending the unconverted oil and the pretreated refined oil fraction may be performed. The blending step may be performed before the vacuum distillation and catalytic dewaxing steps for the unconverted oil, after vacuum distillation and catalytic dewaxing steps, or between the vacuum distillation step and the catalytic dewaxing step. In addition, the process may include a step of blending the unrefined oil fraction with the unconverted oil before the vacuum distillation and catalytic dewaxing steps for the unconverted oil. The details of the process of the present disclosure in each case are as follows but are not limited thereto.

Figure 2:
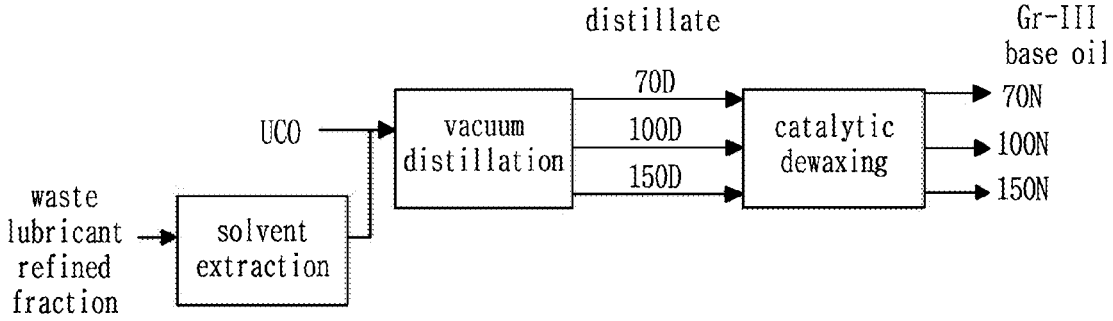
FIG. 2 is a process flowchart according to one embodiment of the present disclosure.
Figure 3:
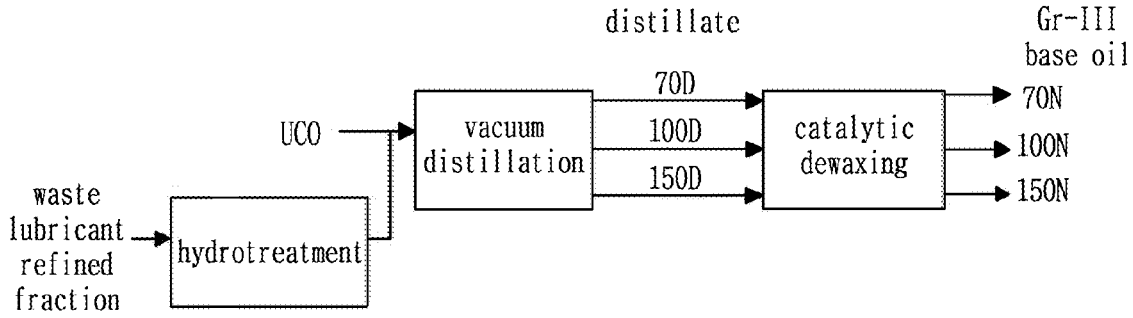
FIG. 3 is a process flowchart according to one embodiment of the present disclosure.

Model 1. Case of Blending Pretreated Refined Oil Fraction with Unconverted Oil Before Vacuum Distillation and Catalytic Dewaxing of Unconverted Oil Referring to FIGS. 2 and 3, a refined oil fraction having undergone solvent extraction and hydrotreating for pretreatment is blended with unconverted oil, and then the mixture undergoes a vacuum distillation step and a catalytic dewaxing step. According to the process of Model 1, the pretreated refined oil fraction of waste lubricant is fractionated according to a boiling point distribution in the vacuum distillation step, and the final products, which are Group III or higher lube base oils (70N, 100N, and 150N fractions in FIGS. 2 and 3) are obtained.

Figure 4:
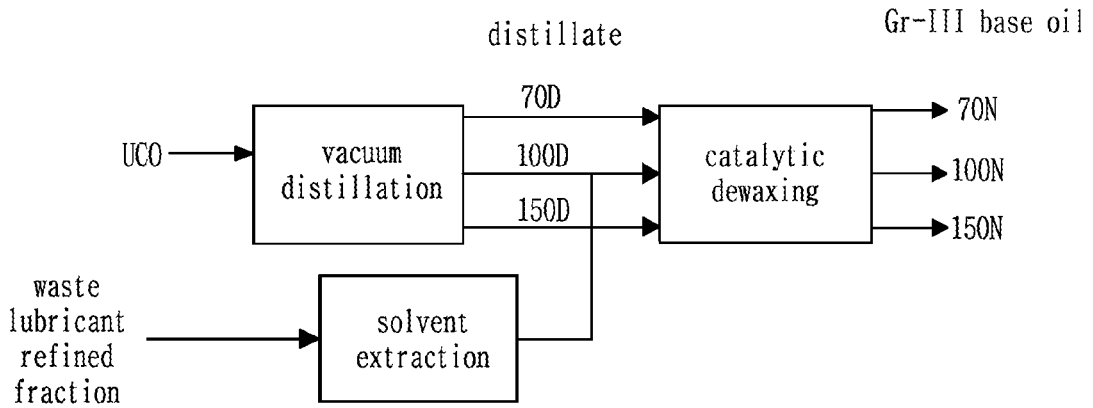
FIG. 4 is a process flowchart according to one embodiment of the present disclosure.
Figure 5:
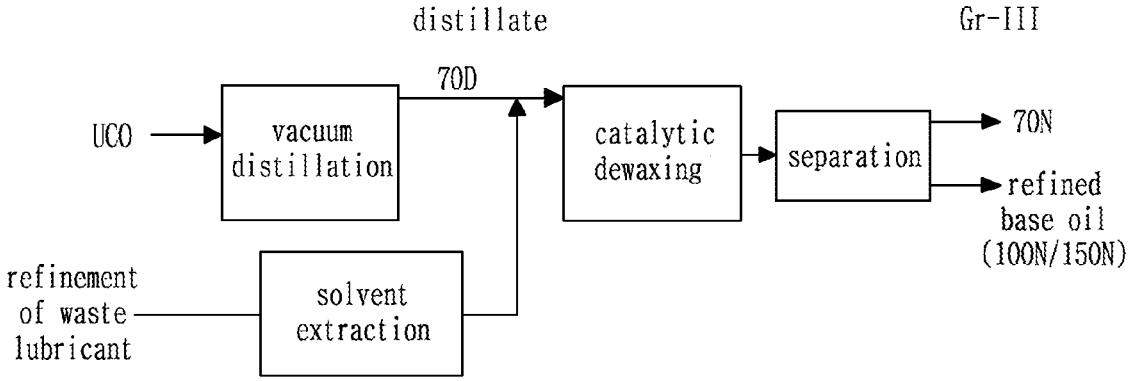
FIG. 5 is a process flowchart according to one embodiment of the present disclosure.
Figure 6:
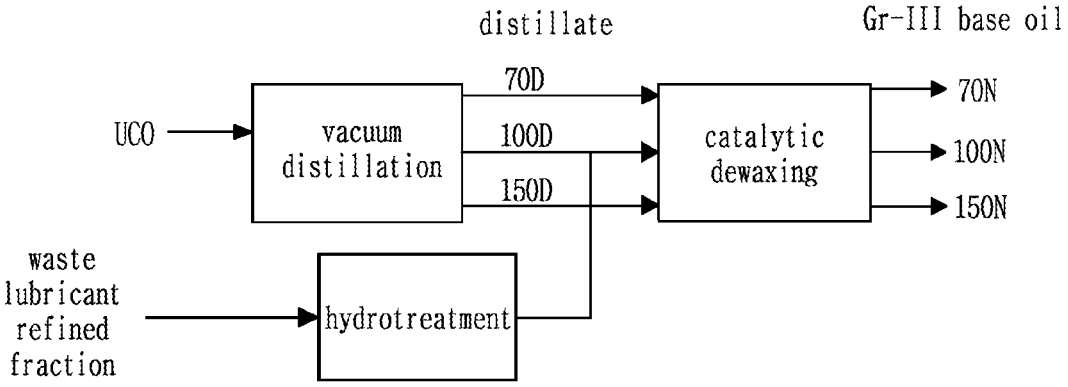
FIG. 6 is a process flowchart according to one embodiment of the present disclosure.

Model 2. Case of Blending Pretreated Refined Oil Fraction with Unconverted Oil Between Vacuum Distillation and Catalytic Dewaxing of Unconverted Oil Referring to FIGS. 4 to 6, a refined oil fraction having undergone solvent extraction or hydrotreating for pretreatment may be blended with a fraction of the components of the unconverted oil fractionated by vacuum distillation. For example, the pretreated refined oil fraction may be blended with the 70 distillate fraction resulting from the vacuum distillation fractionation (FIG. 5), or may be blended with the 100 and 150 distillate fractions resulting from the vacuum distillation fractionation (FIGS. 4 and 6). As described above, when the pretreated refined oil fraction of the waste lubricant is blended with each of the fractions obtained through the vacuum distillation fractionation, it is possible to prepare a lube base oil having a desired boiling point by blending the refined oil fraction with an unconverted oil fraction having a specific boiling point. In the step of blending the refined oil fraction with each fraction of the unconverted oil and of subjecting each mixture to catalytic dewaxing, even though there is a problem in the treatment of any one blended raw material, it does not affect the lube base oil production process in which the treatment of the other blended raw materials is also performed.

In the process configuration, the blending amount of the pretreated refined oil fraction with respect to the unconverted oil is, by volume, in a range of about 3% to 50%, preferably about 5% to 45%, about 5% to 40%, about 5% to 35%, about 5% to 30%, about 5% to 25%, about 5% to 20%, about 5% to 15%, about 5% to 10%, about 7% to 40%, about 7% to 35%, about 7% to 25%, about 7% to 20%, or about 7% to 15%. More preferably, the blending amount of the pretreated refined oil fraction with respect to the unconverted oil by volume is in a range of about 7% to 10%. The pretreated refined oil fraction contains almost no wax component. Therefore, as described above, the pour point is as low as −18° C. to −3° C. When the pretreated refined oil fraction is blended with an unconverted oil having a high pour point of about 42° C., the fluidity of the blended raw material is increased, so that the raw material can be easily transported even at low temperatures. When the blending amount of the pretreated refined oil fraction is lower than 3% by volume, the effect of increasing the fluidity is not significant, so that the blended raw material cannot be easily transported from one step to another. When the blending amount of the pretreated refined oil fraction exceeds 20% by volume, the blended raw material is not suitable as a raw material for producing a high-grade lube base oil due to impurities contained in the refined oil fraction and a low viscosity index.

In Models 1 and 2, the blending raw materials prepared by blending the unconverted oil and the refined oil fraction of waste lubricant has a specific gravity of 0.8 to 0.9, a kinematic viscosity (at 100° C.) of 3 to 8 cSt, a viscosity index of 120 to 140, a pour point of −18° C. to 45° C., a sulfur content of less than 20 ppm, a nitrogen content of less than 5 ppm, and a chlorine content of less than 1 ppm. That is, the blended raw materials of Models 1 and 2 are similar to Group III base oil in properties except for the pour point. In addition, the blended raw material exhibits a yellow color of about 0.5 to 1 according to ASTM standards.

Figure 7:
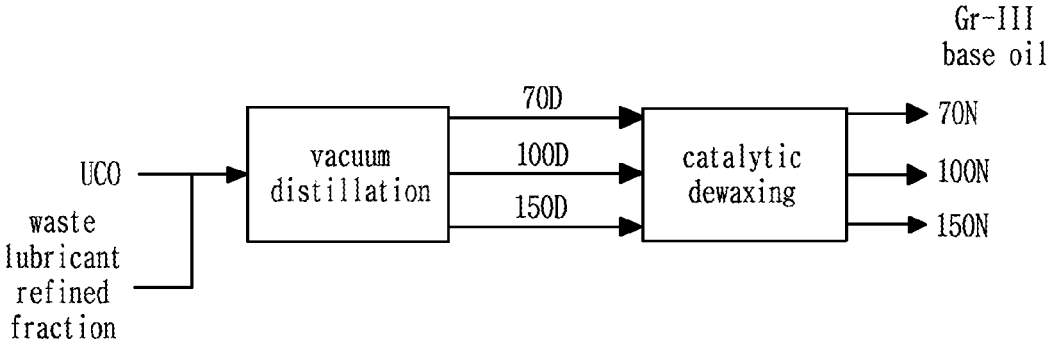
FIG. 7 is a process flowchart according to one embodiment of the present disclosure.

Model 3. Case of Blending Non-Pretreated Refined Oil Fraction with Unconverted Oil Before Vacuum Distillation and Catalytic Dewaxing of Unconverted Oil Referring to FIG. 7, a blended raw material in which a non-pretreated refined oil fraction and an unconverted oil are blended is introduced into a vacuum distillation step and thus fractionated according to boiling point, and each fraction is introduced into a catalytic dewaxing step. Thus, lube base oils are obtained. In this way, when the refined oil fraction is blended with the unconverted oil without pretreatment of the refined oil fraction, there is an advantage in that the process can be simplified. However, in order to control the impurity content in the blended raw material, the blending amount of the refined oil fraction needs to be lower than that in Models 1 and 2.

In the case of Model 3, since the refined oil fraction does not undergo pretreatment steps such as solvent extraction or hydrotreatment, the impurity content of the blended raw material in Model 3 is higher than those in Models 1 and 2. This is a process constraint of the overall advanced lube base oil production process. In Model 3, the blending amount of the refined oil fraction with respect to the unconverted oil is limited to 5% or less by volume.

In addition, the blended raw material of Model 3 has properties similar to the blended raw materials of Models 1 and 2, but has a sulfur content of 100 to 300 ppm, a nitrogen content of 50 to 100 ppm, and a chlorine content of 5 to 20 ppm. That is, the blended raw material of Model 3 exhibits a higher impurity content than that of each of Models 1 and 2.

The vacuum distillation step for the unconverted oil may be performed prior to the catalytic dewaxing step. In the case where the unconverted oil and the refined oil fraction are blended before the vacuum distillation step, the vacuum distillation step for the blended raw material may be performed prior to the catalytic dewaxing step. Typically, the general process sequence is to fractionate and obtain a lube base oil having a desired boiling point by distilling the product resulting from the catalytic dewaxing under reduced pressure. However, in the process of the present disclosure, the vacuum distillation is performed first, and only the fraction having a desired boiling point is catalytically dewaxed. Therefore, it is possible to produce only a product having a desired boiling point, to control the production volume of the product, and to reduce the process scale, resulting in reduction in the operating cost of the process.

The vacuum distillation step for the unconverted oil may be performed under the same process conditions as the vacuum distillation of the waste lubricant in the step of generating the refined oil fraction, whereby the unconverted oil or the blended raw material is fractionated according to the boiling point.

The catalytic dewaxing selectively isomerizes the wax component contained in the unconverted oil or the blended raw material to improve low-temperature properties (to ensure a low pour point) and to maintain a high viscosity index (VI). The present disclosure is intended to achieve improvement in efficiency and yield through improvement of the catalyst used in the catalytic dewaxing process. The catalytic dewaxing step may include a dewaxing reaction and a subsequent hydrofinishing reaction.

In general, the main reaction of the catalytic dewaxing reaction is to convert N-paraffin to iso-paraffin through an isomerization reaction to improve low-temperature properties, and it is reported that the catalyst used here is mainly a bi-functional catalyst. A bi-functional catalyst is composed of two active components: a metal active component (metal site) for hydrogenation/dehydrogenation reaction and a carrier (acid site) for skeletal isomerization using carbenium ions. A catalyst having a zeolite structure is generally composed of an aluminosilicate carrier and at least one metal selected from Group 8 metals and Group 6 metals.

The dewaxing catalyst used in the present disclosure includes a carrier having an acid site selected from molecular sieve, alumina, and silica-alumina, and one or more hydrogenating metals selected from elements of Groups 2, 6, 9 and 10 of the Periodic table. In particular, among the metals in Group 9 and Group 10 (i.e., Group VIII), Co, Ni, Pt, and Pd are preferably used, and among the metals in Group 6 (i.e., Group VIB), Mo and W are preferably used.

The types of carriers having acid sites include molecular sieves, alumina, silica-alumina, and the like. Among these, the molecular sieves refer to crystalline aluminosilicates (zeolite), SAPO, ALPO, and the like. A medium pore molecular sieve with a 10-membered oxygen ring, such as SAPO-11, SAPO-41, ZSM-11, ZSM-22, ZSM-23, ZSM-35, and ZSM-48 is used, and a large pore molecular sieve with a 12-membered oxygen ring may be used.

In particular, in the present disclosure, EU-2 zeolite having a controlled phase transition degree may be preferably used as a carrier. After pure zeolite is generated, the synthesis conditions are likely to change, or the synthesized zeolite crystal is likely to gradually transition to a more stable phase if the synthesis continues over a predetermined period time. This phenomenon is referred to as phase transformation of zeolite. It was confirmed that isomerization selection performance was improved according to the degree of phase transformation of the zeolite, and excellent performance was also exhibited in the catalytic dewaxing reaction using the same.

The lube base oil produced by the process described above may be a high-grade lube base oil having a grade of Group III or higher in the API classification described above. More specifically, the lube base oil has a viscosity index of 120 or more, preferably 120 to 140, 120 to 135, 120 to 130, 120 to 125, 125 to 140,125 to 135,125 to 130,130 to 140, or 130 to 135, and the degree of saturation is 90% or more, preferably 91% or more, 92% or more, 93% or more, 94% or more, 95% or more, 96% or more, 97% or more, 98% or more, or 99% or more.

In addition, the lube base oil may contain almost no impurities since the content of each of the impurities such as sulfur, nitrogen, and chlorine is 1 ppm or less.

The lube base oil may have a Saybolt Color value of 27 or greater, when measured by ASTM D 156. When the lube base oil has a Saybolt Color value is 27 or greater, it is considered that this lube base oil is a lube base oil having stability corresponding to Water White grade. Water White grade lube base oil has a sulfur and nitrogen content of less than 1 ppm, a saturation of 99% or more, and an aromatic content of less than 1%. This lube base oil is more stable than a conventional API Group III lube base oil.

The lube base oil may exhibit a UV 260-350 nm absorbance of 2.5 or less and a UV 325 nm absorbance of 0.7 or less, as measured by ASTM D 2008. Here, the absorbance at a wavelength of 260 to 350 nm indicates that the test material contains a component having 3 or more aromatic rings, and the absorbance at a wavelength of 325 nm indicates that the test material contains a component having 3 to 7 aromatic rings. The lube base oil exhibits a low absorbance at these wavelengths. That is, the lube base oil has a low aromatic content, thereby having high stability.

The properties and impurity content of exemplary oils in each step of the process are shown in the table below.

TABLE 2

| | Waste lubricant | Refined oil fraction | Pretreatment 1 (solvent extraction) | Pretreatment 2 (hydrogenation) | Blended raw material | Lube base oil |
|---|---|---|---|---|---|---|
| Specific gravity | 0.8 to 0.9 | 0.8 to 0.9 | 0.8 to 0.9 | 0.8 to 0.9 | 0.8 to 0.9 | 0.8 to 0.9 |
| Kinetic viscosity (at 100° C.), cSt | 2 to 20 | 4 to 6 | 4 to 6 | 4 to 6 | 3 to 8 | 3 to 8 |
| Viscosity index | 60 to 150 | 100 to 120 | 110 to 130 | 100 to 130 | 120 to 140 | 110 to 130 |
| Pour point | −18 to 12 | −18 to −3 | −18 to −3 | −18 to −3 | 12 to 45 | −39 to −12 |
| Sulfur, ppm | 1000 to 3000 | 200-1000 | 70 to 150 | 0 to 20 | 0 to 50 | 0 to 1 |
| Nitrogen, ppm | 500 to 2000 | 200 to 400 | 40 to 100 | 0 to 5 | 0 to 10 | 0 to 1 |
| Chlorine, ppm | 100 to 2000 | 30 to 2000 | 5 to 20 | 0 to 1 | 0 to 2 | 0 to 1 |
| Aromatic compound, wt % | 10% or more | 0 to 10 | 0 to 5 | 0 to 1 | 0 to 2 | 0 to 1 |

(Here, Pretreatment 1 or Pretreatment 2 is selectively performed)

Hereinafter, preferred examples are presented to help the understanding of the present disclosure, but the following examples are provided only for easier understanding of the present disclosure, and thus the present disclosure is not limited thereto.

Example

1. Measurement of Behavior of Lube Base Oil Produced by Process of Present Disclosure A waste lubricant having a sulfur content of about 2000 ppm, a nitrogen content of about 1500 ppm and a chlorine content of about 1500 ppm was centrifuged at a speed of about 300 rpm, followed by atmospheric distillation and vacuum pressure distillation, to obtain a refined oil fraction of the waste lubricant. The obtained refined oil fraction was hydrotreated, the treated refined oil fraction is blended with an unconverted oil as in Model 1 such that the blending ratio of the treated refined oil fraction with respect to the unconverted oil is 25% by volume. The resulting mixture underwent vacuum distillation and catalytic dewaxing to generate a lube base oil. Here, the atmospheric distillation was performed at a temperature of 50° C. to 350° C. and at atmospheric pressure. The process conditions of the vacuum distillation are shown in Table 3 below.

TABLE 3

| Process conditions of vacuum distillation | |
|---|---|
| Temperature | 100° C. to 350° C. |
| Pressure | 10 torr |

Process conditions of the hydrotreatment are shown in Table 4 below.

TABLE 4

| Process conditions of hydrotreatment | |
|---|---|
| Temperature | 350° C. |
| Pressure | 150 kg/cm$^2$ |
| Catalyst | Ni-Mo catalyst |

In addition, the catalytic dewaxing was performed in the presence of a hydrogenation catalyst using EU-2 zeolite as a carrier at a temperature of 300° C. and at a pressure of 150 kg/cm$^2$. During the process, the properties and various characteristics of the lube base oil prepared by the process of Model 1 were measured. The measurement indicated that the lube base oil exhibited a specific gravity of 0.84, a kinematic viscosity at 100° C. of 7.3 cSt, a viscosity index (VI) of 129, and a kinematic viscosity of −33° C. In the lube base oil, the content of each of sulfur, nitrogen, and chlorine was less than 1 ppm. That is, no impurities were contained except for a trace of inevitable impurities.

In addition to the above, the properties measured for the lube base oil are shown in Table 5 below.

TABLE 5

Characteristics of lube base oil produced by the process of Model 1 of the present disclosure.

| Item | Test method | Specification |
|---|---|---|
| Appearance | Visual | Bright & Clear |
| Saybolt color | ASTM D 156 | Min. +27 |
| Saturation, % | ASTM D 7419 | Min. 99 |
| UV 260-350 nm | ASTM D 2008 | Max. 3.0 |
| UV 325 nm | ASTM D 2008 | Max. 1.0 |
| Viscosity index | ASTM D 2270 | Min. 120 |

The lube base oil had a viscosity index of at least 120 and a saturation degree of at least 95%, indicating that the lube base oil satisfies the conditions required for Group III lube base oil shown in Table 1. The base oil had a bright and clean color when visually evaluated with eyes. The color was a Saybolt color value of 27 or more, when measured according to ASTM D 156. That is, the lube base oil is a lube base oil having a water white grade, and the lube base oil has high thermal stability at high temperatures.

In addition, the lube base oil exhibits a low absorbance of up to 3.0 (up to 1.0 at a wavelength of 325 nm) when measured according to ASTM D 2008 for UV having a wavelength of 260 to 350 nm, and especially for UV having a wavelength of 325 nm. It was confirmed that the lube base oil had high stability against UV.

2. Evaluation of Lube Base Oil Production Yield with or without Blending with Refined Oil Fraction of Waste Lubricant A lube base oil was obtained under the same process conditions as in Example 1, except that the refined oil fraction of the waste lubricant was mixed with an unconverted oil. The results of comparing the yield of this case and the yield of Example 1 are shown in Table 6 below.

TABLE 6

| | Production yield of lube base oil (wt %) |
|---|---|
| Process conditions of Example 1 (blended with refined oil fraction) | 93-94% |
| Not blended with refined oil fraction | 93% |

As described above, when a lube base oil was produced using a raw material blended with unconverted oil as a feedstock, the lube base oil exhibited a yield equal to or slightly higher than that of the case where only unconverted oil was used as a feedstock. The reason seems to be the fact that the refined oil fraction does not contain wax components such as N-paraffins at all while the unconverted oil contains about 15% of N-paraffins. As described above, when a predetermined amount of a refined fraction of waste lubricant is blended with an unconverted oil, and the mixture is used as a feedstock for preparation of a lube base oil, the stability and yield of the final product, which is a lube base oil, may be increased. In addition, this process is also advantageous in an environmental aspect because waste lubricant is recycled as a lube base oil.

What is claimed is:

1. A process of producing a high-quality lube base oil using a refined oil fraction of waste lubricant, the process comprising:

preparing a refined oil fraction by refining waste lubricant;

pretreating the refined oil fraction; and blending the pretreated refined oil fraction with unconverted oil before vacuum distillation and catalytic dewaxing of the unconverted oil, or between the vacuum distillation and the catalytic dewaxing, wherein the vacuum distillation is performed before the catalytic dewaxing, and wherein the unconverted oil refers to a heavy fraction remaining without being converted to fuel oil through a fuel oil hydrocracking process.

2. The process of claim 1, wherein the preparing of the refined oil fraction comprises: centrifuging the waste lubricant; performing atmospheric distillation; performing vacuum distillation; or performing combinations thereof.

3. The process of claim 1, wherein the pretreating of the refined oil fraction comprises solvent extracting or hydrotreating the refined oil fraction.

4. The process of claim 3, wherein a solvent used for the solvent extraction is selected from the group consisting of N-methyl-2-pyrrolidone, Sulfolane, DMSO, furfural, phenol, acetone, and combinations thereof.

5. The process of claim 3, wherein the solvent extraction is carried out at a temperature in a range of 40° C. to 120° C. and at a pressure in a range of atmospheric pressure to 10 kg/cm$^2$.

6. The process of claim 3, wherein the solvent extraction is carried out in a condition in which a volume ratio of solvent to oil is in a range of 1:1 to 6:1.

7. The process of claim 3, wherein the hydrotreatment is carried out at a temperature in a range of 200° C. to 400° C. and at a pressure in a range of 100 to 200 kg/cm$^2$.

8. The process of claim 1, wherein the vacuum distillation is performed before the catalytic dewaxing.

9. The process of claim 1, wherein the catalytic dewaxing is performed in the presence of a catalyst comprising an EU-2 zeolite carrier.

10. The process of claim 1, wherein the amount of the refined oil fraction blended with the unconverted oil is 3% or more and 50% or less by volume.

11. The process of claim 1, wherein a blended raw material obtained by blending the refined oil fraction with the unconverted oil has a sulfur content of less than 50 ppm, a nitrogen content of less than 10 ppm, and a chlorine content of less than 2 ppm.

12. The process of claim 1, wherein the lube base oil has a viscosity index of 120 or more and a saturation degree of 90% or more.

13. The process of claim 12, wherein the lube base oil has a Saybolt color value of 27 or more.

14. The process of claim 12, wherein the lube base oil has a saturation degree of 99% or more.

15. The process of claim 12, wherein the lube base oil contains sulfur, nitrogen, and chlorine each of which is contained in a concentration of less than 1 ppm.

* * * * *